US006261396B1

(12) United States Patent
Fessenden et al.

(10) Patent No.: US 6,261,396 B1
(45) Date of Patent: Jul. 17, 2001

(54) METHODS AND COMPOSITIONS FOR REPAIRING HOSIERY

(76) Inventors: Ralph J. Fessenden, 9300 Butler Creek Rd., Missoula, MT (US) 59802; Patricia J. Jacobsen, P.O. Box 16262, Missoula, MT (US) 59808

( * ) Notice: Subject to any disclaimer, the term of this patent is extended or adjusted under 35 U.S.C. 154(b) by 0 days.

(21) Appl. No.: 09/276,855

(22) Filed: Mar. 26, 1999

(51) Int. Cl.[7] ..... B32B 33/00; B31B 1/60; C09J 4/00; C09J 101/00; C09J 201/00

(52) U.S. Cl. ..... 156/90; 156/60; 156/88; 156/94; 156/163; 156/278; 156/280; 156/305; 156/327; 156/338; 401/118; 401/119; 427/207.1; 427/389.9; 427/385.5; 427/393.5; 428/63; 524/571

(58) Field of Search ..... 524/571; 156/60, 156/88, 94, 278, 280, 305, 327, 338, 90, 163; 427/207.1, 389.9, 385.5, 393.5; 401/118, 119; 428/63

(56) References Cited

U.S. PATENT DOCUMENTS

| | | | | |
|---|---|---|---|---|
| 2,172,251 | | 9/1939 | Copeman . | |
| 4,068,322 | | 1/1978 | Rathel . | |
| 4,324,603 | | 4/1982 | Crandall et al. . | |
| 4,994,127 | | 2/1991 | Sallenbach . | |
| 5,042,088 | * | 8/1991 | Sherrod et al. | 2/53 |
| 5,087,496 | | 2/1992 | Bouchoucha . | |
| 5,151,302 | * | 9/1992 | Kent et al. | 427/140 |
| 5,262,237 | * | 11/1993 | Chen et al. | 427/393.5 |
| 5,338,784 | | 8/1994 | Kent et al. . | |

OTHER PUBLICATIONS

The Chemical Formulary, H. Bennett Ed., 1968, p. 324.

* cited by examiner

*Primary Examiner*—Patrick D. Niland
(74) *Attorney, Agent, or Firm*—Saliwanchik, Lloyd & Saliwanchik, P.C.

(57) ABSTRACT

The subject invention pertains to compositions comprising a rubber-like polymer and low boiling point alkanes which can be used to provide a flexible, durable, permanent repair for snags, holes, runs or ladders in hosiery such as pantyhose and nylon stockings. In a preferred embodiment, the rubber-like polymer is a gum-like residue obtained from drying commercial rubber cement adhesive. A composition comprising 2% weight to volume of this residue in an equal volume solvent system of pentane and hexane is applied to the snag and allowed to dry. When the repair is made while the stocking is being worn, a thin, transparent shield can be inserted between the stocking and the skin of the person wearing the stocking. The shield protects the skin from the composition yet does not adhere to the skin or stocking. The shield therefore can be easily removed after the composition is dry or can be left in place between the skin and the hosiery. The invention also pertains to methods of repairing hosiery and kits for hosiery repair.

4 Claims, No Drawings

METHODS AND COMPOSITIONS FOR REPAIRING HOSIERY

BACKGROUND OF THE INVENTION

A run or snag in a pair of pantyhose or nylon stockings can ruin one's day. Besides the embarrassment and the feeling of self-consciousness the run inspires, there is disappointment in the loss of what can be a substantial investment. A pair of pantyhose can cost as much as twenty dollars a pair.

Hosiery such as pantyhose or nylon stockings are articles knit of thin fine threads. Knitting joins loops of fibers to form the garment. Although there have been many attempts to make knit articles resistant to damage (see, for example, U.S. Pat. No. 2,172,251), when a loop is snagged in a knit article the thread becomes loosened or broken allowing the fabric to unravel or run. The loose end slips through each adjoining loop allowing the fabric to expand or gap at that point to form the run or ladder. The more the hosiery is stretched, the faster the run develops and the greater the damage to the stocking.

To prevent damage from becoming extensive, the loose thread must be contained and not allowed to move while the stocking is being stretched. There are two methods by which a loose thread is immobilized to prevent further damage. The loose thread is either glued in place or a patch is applied over the area immobilizing the thread.

A glue immobilizes a loose thread by binding the loose end to others in the weave of the stocking. The glue also binds to itself Therefore, the broken thread is encased in a glue mass which cannot be pulled free and perpetuate the run when the stocking is stretched. The glue must surround all of the threads near the head of the run requiring a generous application of glue.

The most commonly used glue to stop runs after a snag is clear nail polish. Nail polish is often used to make repairs while the stocking is being worn. It is applied directly to the snag and dries to a white, hard, brittle solid that often bonds the stocking to the leg. This white solid is particularly noticeable and unattractive with dark colored stockings. Further, when the stockings are removed, the hard solid often causes additional snags and runs. The stockings also can usually not be worn again after washing.

Other glues for repairing runs and snags in hosiery have been described. For example, Sallenbach (U.S. Pat. No. 4,994,127) suggests a cyanoacrylate glue be used with a oneshot applicator. This glue however also dries to a brittle solid and can stick to the skin of someone wearing the hosiery. The Chemical Formulary (Bennett, ed., 1968) lists a stocking run stopper of "acyloid" B-72 and alcohol. Kent et al. (U.S. Pat. No. 5,151,302, 5,338,784) describes a mixture of nitrocellulose and a plasticizer as a glue to repair hosiery. The plasticizer allows flexibility in the repaired area. The adhesives of Kent et al. however contain chemicals which may irritate or dry the skin.

Various patches and patching systems have been described to repair hosiery. Crandall (U.S. Pat. No. 4,324,603) described a kit having a device that dispenses a patching tape. The patch binds the loose thread of a run to others in the area of the run preventing it from slipping through adjacent loops and allowing the fabric to unravel. Rathel (U.S. Pat. No. 4,068,322) describes a system in which a patch is applied to the inside and outside of the stocking each patch having a pressure sensitive adhesive. Bouchoucha (U.S. Pat. No. 5,087,496) uses a nylon hook and loop fastener system such as the product VELCRO to attach a patch to the stocking. Patches however are cumbersome and do not stretch, sometimes causing further damage to the repaired stocking as well as creating new imperfections. Furthermore, patches do not efficiently capture the loose thread. Thus the run may continue even though a patch was applied.

Glues and patches available for repairing hosiery are therefore insufficient. Glues generally have not been satisfactory because they take too long to dry, leave a sticky, unsightly glob on the stocking and are inconvenient to apply. Additionally, glues can stick to the skin and cause skin irritations. Patches are cumbersome, ineffective and often cause more damage to the stocking. From the foregoing, it is apparent that there remains a need for a safe, effective, durable method by which to repair hosiery.

BRIEF SUMMARY OF THE INVENTION

The subject invention relates to compositions for repairing hosiery such as pantyhose and similar garments. The compositions are fabric adhesives comprising a rubber-like polymer in a low boiling point alkane solvent. In a preferred embodiment, the rubber-like polymer is the gum-like residue obtained from drying commercial rubber cement adhesive. A preferred composition of 2% weight to volume of this residue in a solvent system of hexane, or a mixture of pentane and hexane, applied to a snag, hole, run or ladder in hosiery provides a durable, flexible and permanent repair.

The subject invention also concerns methods of repairing fabric and hosiery. The subject composition is applied to a run, snag or hole in the hosiery and allowed to dry. If the hosiery is repaired while it is being worn, a shield may be placed between the hose and the skin of the person wearing the stocking to prevent the composition from contacting the skin. The composition does not adhere to the shield. The shield is thin, flexible and transparent and can be removed or left in place once the composition is dry.

DETAILED DESCRIPTION OF THE INVENTION

The invention relates generally to methods and compositions for repairing fabric and more specifically to repairing hosiery. The composition of the subject invention is applied to a snag, hole, run or ladder in hosiery and allowed to dry. Hosiery can be repaired using the subject composition while the hosiery is being worn. A shield can be inserted between the hosiery and the skin of the person wearing the hose to prevent the subject composition from contacting the skin.

The compositions of the subject invention comprise a rubber-like polymer in a solvent mixture of low boiling point alkanes. The composition applied to an imperfection in hosiery and allowed to dry provides a durable, flexible, permanent repair. Imperfections in hosiery include any disturbances in the integrity of the fabric including, but not limited to, pulled threads or snags, broken threads, tears, holes and runs or ladders.

The compositions comprise rubber-like polymers. These compounds provide structure and flexibility to the repair and are present in the subject composition at from about one percent to about four percent weight to volume. Rubber-like polymers suitable for use in the composition of the subject invention include any member of a class of non-vulcanized elastomers whose properties can be altered by mastication. Mastication of a suitable elastomer of this class causes a decrease in molecular weight, conversion to a soft gummy mass, and an increase of the solubility of the elastomer in a hydrocarbon solvent. Typical members of this class of elastomers are natural rubber and styrene-butadiene (SBR) rubber.

In a preferred embodiment of the subject composition, the rubber-like polymer is a gum-like residue that can be obtained from commercial rubber cement. Commercial rubber cement sold as a paper adhesive is allowed to dry to an off-white rubber-like non-tacky gum. The dried rubber cement (DRC) provides strong, flexible structure to the subject composition. It is important that this polymer and all other polymers useful according to the subject invention are easily dissolved in the low boiling point alkanes of the subject composition.

A solvent mixture comprising low boiling point alkanes dissolves the polymer for application and evaporates rapidly on site to provide a durable repair. The boiling point of these solvents should be about less than or equal to 98° C. so that they evaporate rapidly allowing a convenient, efficient repair time. Suitable alkanes contemplated for use in the subject composition include, but are not limited to, pentane, hexane, heptane, and their isomers. A mixture of these alkanes is particularly preferred for use in the composition of the subject invention. An equal volume mixture of hexane which has a boiling point of 69° C. and pentane which has a boiling point of 36° C. evaporates within less than one minute to provide a rapid repair. Alternatively, hexane or a mixture of hexane isomers can be used.

A particularly preferred embodiment of the composition of the subject invention comprises 2% weight to volume dried rubber cement in an equal volume solvent mixture of hexane and pentane. When this composition is applied to hosiery such as a stocking the solvent evaporates in less than a minute leaving a very thin film of the polymer on the threads of the stocking. The very thin layer of polymer changes the physical characteristics of the threads. In the absence of the polymer the threads are smooth and slippery. A loose thread slides easily through the loops of the knit allowing the stocking to run. When a fine layer of polymer is applied to the threads, they lose their smoothness and slipperiness and become slightly sticky. The loose thread no longer slips through the loops as the stocking is stretched. As the stocking is stretched extremely, the proximal loop tightens around the loose thread holding it in place which prevents furthering the run. The composition of the subject invention therefore does not act as a glue but as an adhesive affecting the stickiness of the threads. In contrast, a glue binds a broken thread to other threads in a glue mass and coats the broken thread preventing it from slipping through the loops of the fabric.

The compositions of the subject invention can be applied directly to a snag and/or run and to the area of the hosiery immediately surrounding the damage. For a run, or the beginning of a run, the composition is applied both to the head of the run and to its sides. This prevents both horizontal and vertical development of the run. The subject composition completely penetrates the fibers of the stocking in the small region of its application. When the solvent in the subject composition evaporates, a very fine deposit of the rubber-like polymer is left on the fibers. The deposited polymer is barely noticeable. The compositions of this invention can be tinted, for example, with artist's oil paint, to match the color of the hosiery or the skin, thereby making the deposited polymer practically invisible. The strong, flexible repair can withstand washing allowing the repaired stocking to be worn again.

A preferred embodiment of the composition of the subject invention comprises chemicals which may cause skin irritations in some individuals. Certain petroleum alkanes can irritate the skin of some individuals and, therefore, a shield is provided for use with the compositions of the subject invention for those who wish to use it. In one embodiment, the shield comprises a piece of clear plastic film of reasonable thickness that is completely flexible. Polyethylene or polypropylene sheets of from about 4 to about 8 mil thick, and preferably about 6 mil thick, would be suitable for use as a shield. Similarly, like substances of these approximate thicknesses can also be used as a shield. For comfort, the shield can be an oval or circle, however, the shield can be any shape. The transparent shield is placed between the skin of the leg and the damaged area of the hosiery. It is left in place as long as the individual wishes. The subject composition is then applied to the hosiery while on the leg. The shield prevents the chemicals in the composition from contacting the skin. The shield does not bond to the hosiery or skin. The shield can be removed when the composition dries or removed at the end of the day when the hosiery is removed. The shield can be reused and reinserted the next time the hosiery are worn if the individual wishes.

Compositions of the subject invention can be included in a kit for repairing hosiery. The kit can contain a small container or bottle of the composition with an applicator for applying the composition to damaged hosiery. The applicator is preferably a small, soft bristle brush similar to that provided for nail polish. Other suitable applicators include all types of brushes, wands or sponges. Tints or dyes can be included in the kit so the compositions can be color matched to the damaged hosiery. Preferably, the kit includes a shield to protect the skin of the wearer from the subject composition. When an imperfection is identified in hosiery, such as a stocking, the wearer can insert the shield between the skin and the stocking. The wearer then applies a thin coat of the composition of the subject invention to the imperfection with the brush. The composition is allowed to dry and the repair is complete. The shield can be removed or left in place for the remainder of the day.

The following examples are offered to further illustrate but not limit both the compositions and the methods of the present invention. All percentages are by weight and all solvent mixture proportions are by volume unless otherwise noted.

EXAMPLE 1

Preparation of a Preferred Rubber-like Polymer.

A preferred rubber-like polymer for use in the composition of the subject invention is the gum-like residue obtained from commercial rubber cement. The residue was prepared as follows:

The contents of a bottle of retail rubber cement (BEST-TEST paper cement, Union Rubber, Inc.) sold as a paper adhesive was poured onto a metal cookie sheet. The solvent was allowed to evaporate at room temperature. The dried rubber cement residue (DRC) was an off-white rubber-like, non-tacky gum. The DRC was scraped from the sheet and weighed for use in the subject composition.

EXAMPLE 2

Composition for Repairing Hosiery.

A preferred embodiment of the composition of the subject invention comprises 2% weight to volume DRC in an equal volume solvent system of pentane and hexane.

| | |
|---|---|
| DRC | 500 mg |
| pentane | 12.5 mL. |
| hexane | 12.5 mL. |

The composition applied with a small brush to a nylon stocking dries in approximately 30–40 seconds.

EXAMPLE 3

Composition for Repairing Hosiery.

A preferred embodiment of the composition of the subject invention comprises 2% weight to volume DRC in a hexane solvent.

| | |
|---|---|
| DRC | 500 mg |
| hexane | 25 mL. |

The composition applied with a small brush to a nylon stocking dries in approximately 30–40 seconds.

It is understood that the foregoing examples are merely illustrative of the present invention. Certain modifications of the compositions and/or methods employed may be made and still achieve the objectives of the inventions. Such modifications are contemplated as within the scope of the claimed invention.

What is claimed is:

1. A method of repairing hosiery comprising the steps of:

detecting an imperfection in the hosiery;

applying a composition comprising a non-vulcanized, masticated elastomer and at least one alkane having a boiling point of less than about 98 degrees Celsius to the imperfection; and allowing the composition to dry.

2. The method of claim 1, wherein said hosiery is being worn by a person, said method further comprising the steps of:

placing a shield between said hosiery and the skin of the person before applying said composition to said imperfection.

3. The method of claim 2, further comprising the steps of:

removing said shield after said composition is dry.

4. The method of claim 2, wherein said shield is a thin, transparent plastic film selected from the group consisting of polyethylene and polypropylene.

* * * * *